US008827178B2

(12) United States Patent
Roney et al.

(10) Patent No.: US 8,827,178 B2
(45) **Date of Patent: *Sep. 9, 2014**

(54) IRRIGATION ROTOR SENSOR

(75) Inventors: T. Lynn Roney, Oro Valley, AZ (US); Steven Sharp, Tucson, AZ (US)

(73) Assignee: Rain Bird Corporation, Azusa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/689,775

(22) Filed: Jan. 19, 2010

(65) Prior Publication Data

US 2010/0116901 A1 May 13, 2010

Related U.S. Application Data

(63) Continuation of application No. 11/289,157, filed on Nov. 28, 2005, now Pat. No. 7,648,082.

(51) Int. Cl.

| | |
|---|---|
| ***B67D 7/08*** | (2010.01) |
| ***B05B 15/10*** | (2006.01) |
| ***B05B 3/00*** | (2006.01) |
| ***B05B 3/04*** | (2006.01) |
| ***B05B 3/10*** | (2006.01) |

(52) U.S. Cl.

CPC . *B05B 15/10* (2013.01); *B05B 3/04* (2013.01); *B05B 3/1085* (2013.01); *Y10S 239/11* (2013.01)

USPC ..... 239/73; 239/71; 239/203; 239/204; 239/206; 239/DIG. 11

(58) Field of Classification Search

USPC ..... 239/589, DIG. 11, 200, 201, 203, 207, 239/177, 209, 71, 73, 79, 204, 206

See application file for complete search history.

(56) References Cited

U.S. PATENT DOCUMENTS

| | | | | |
|---|---|---|---|---|
| 3,118,075 | A * | 1/1964 | Dunn et al. | 310/36 |
| 3,915,383 | A | 10/1975 | King | |
| 4,353,506 | A | 10/1982 | Hayes | |
| 4,936,507 | A | 6/1990 | Weinstein | |
| 5,528,218 | A | 6/1996 | Rigsby | |
| 5,597,119 | A | 1/1997 | Gorney et al. | |
| 5,938,849 | A | 8/1999 | Watts | |
| 6,084,400 | A * | 7/2000 | Steinich et al. | 324/207.13 |

(Continued)

FOREIGN PATENT DOCUMENTS

WO 2004/091286 A2 10/2004

OTHER PUBLICATIONS

European Patent Office, European Search Report for European Application No. 06 016 815.0 dated Apr. 22, 2009, 6 pages.

(Continued)

*Primary Examiner* — Ryan Reis

(74) *Attorney, Agent, or Firm* — Fitch, Even, Tabin & Flannery, LLP

(57) ABSTRACT

An irrigation sprinkler is for use in distributing water to an area of vegetation, and has a rotatable nozzle for dispersing the water by rotation of the nozzle. A magnet is coupled or connected to the nozzle and rotates synchronously with the rotation of the nozzle. A sensor unit is disposed adjacent to the nozzle and detects a magnetic field generated by the magnet during nozzle rotation to generate a signal indicative of the speed and direction of rotation of the nozzle.

33 Claims, 5 Drawing Sheets

(56) References Cited

U.S. PATENT DOCUMENTS

| | | | | |
|---|---|---|---|---|
| 6,400,141 | B1 | 6/2002 | Apel et al. | |
| 6,481,293 | B1 | 11/2002 | Walczak et al. | |
| 6,486,653 | B2 | 11/2002 | Osborn et al. | |
| 6,512,366 | B2 * | 1/2003 | Siess | 324/207.25 |
| 6,592,054 | B2 | 7/2003 | Prus | |
| 6,688,535 | B2 | 2/2004 | Collins | |
| 6,703,829 | B2 * | 3/2004 | Tola | 324/207.25 |
| 6,735,269 | B2 * | 5/2004 | Siess et al. | 377/16 |
| 6,741,158 | B2 | 5/2004 | Engler et al. | |
| 6,789,434 | B2 | 9/2004 | Peterson | |
| 6,847,205 | B2 * | 1/2005 | Puech | 324/207.25 |
| 6,860,988 | B2 | 3/2005 | MacDonald et al. | |
| 7,111,796 | B2 * | 9/2006 | Olson | 239/452 |
| 7,631,813 | B1 * | 12/2009 | Lichte et al. | 239/11 |
| 7,648,082 | B2 | 1/2010 | Roney et al. | |
| 8,444,063 | B2 | 5/2013 | Lichte et al. | |
| 2001/0015386 | A1 | 8/2001 | Pruss | |
| 2002/0125338 | A1 | 9/2002 | Collins | |
| 2004/0135001 | A1 | 7/2004 | Collins | |
| 2004/0189283 | A1 | 9/2004 | Godoy et al. | |
| 2013/0105604 | A1 | 5/2013 | Lichte et al. | |

OTHER PUBLICATIONS

Response dated Dec. 14, 2011, from related European Patent Application 06 016 815.0, 11 pages.

Extended European Search Report dated Mar. 29, 2012, from related European Patent Application 11 193 501.1, 6 pages.

* cited by examiner

IRRIGATION ROTOR SENSOR

CROSS-REFERENCE TO RELATED APPLICATION

This application is a continuation of prior application Ser. No. 11/289,157, filed Nov. 28, 2005, which issued as U.S. Pat. No. 7,648,082 B2 on Jan. 19, 2010, and which is hereby incorporated herein by reference in its entirety.

FIELD OF THE INVENTION

This relates to irrigation system components, and more specifically, to irrigation rotor sprinklers.

BACKGROUND OF THE INVENTION

Pop-up irrigation rotor sprinklers are known in the art and are especially useful where it is desired that they be placed in the ground so that they are at ground level when not in use. In a typical pop-up rotor sprinkler, a tubular riser is mounted within a generally cylindrical upright sprinkler housing or case having an open upper end. A spray head carrying one or more spray nozzles is mounted at an upper end of the riser and supports a housing cap or cover to close the housing when the sprinkler is not in operation.

In a normal inoperative position, the spray head and riser are spring-retracted into the sprinkler case so that they are below ground level. However, when water under pressure is supplied to the sprinkler case, the riser is extended upwardly to shift the spray head to an elevated spraying position spaced above the sprinkler case and the ground. The water under pressure flows through a vertically oriented passage in the riser to the spray head which includes one or more appropriately shaped spray nozzles for projecting one or more streams of water radially outwardly over a surrounding terrain area and vegetation.

In many pop-up sprinklers, a rotary drive mechanism is provided within the sprinkler case for rotatably driving the spray head through continuous full circle revolutions, or alternately, back and forth within a predetermined part-circle path, to sweep the projected water stream over a selected target terrain area. In one known design, the rotary drive mechanism comprises a water-driven turbine which is driven by the pressurized water supplied to the sprinkler case. This turbine rotatably drives a speed reduction gear drive transmission coupled in turn to the rotary mounted spray head. In addition, adjustable means are normally provided to cause spay head rotation to reverse upon reaching a predetermined, part-circle path of motion, or to achieve continuous, full-circle rotation, if desired.

While these sprinklers generally provide reliable service, from time to time they can malfunction due to the wearing of parts or to debris entering the units thereby obstructing or clogging their interior components. Malfunctions can include a failure of the riser to extend upwardly, or a failure to rotate at the proper speed or direction. It is therefore necessary for an operator to directly observe the sprinklers when they are in operation to ensure that they are in proper working order.

For irrigation systems installed in large facilities, such as for example, golf courses, this direct observation by a user often requires that he or she take the time to travel throughout the entire facility to observe the operation of a plurality of sprinklers. What would be desirable, therefore, is an improved irrigation device that provides some automatic indication and verification of proper sprinkler operation.

SUMMARY

Embodiments of the invention provide a new and improved rotary sprinkler that includes a relatively simple, inexpensive, yet reliable assembly for automatically and accurately indicating the operating condition of the sprinkler and which can provide the information to a central control station for alerting an operator of any potential sprinkler irrigation problems. More specifically, embodiments of the invention employ a Hall-effect sensor that is adapted to detect the position or rotation of the sprinkler in order to provide a signal indicative of the sprinkler condition and rate of rotation. This signal can be transmitted, either wirelessly or via conductors, to a central control station for automatic response or observation by the system operator.

According to one embodiment of the invention, a sprinkler nozzle assembly is rotatable and has one or more magnets coupled or connected to the assembly so that they synchronously rotate with it. A sensor unit is mounted adjacent to the magnets and provides electrical signals in response to the magnetic fields produced by the rotating magnets. These electrical signals are used to provide information as to both the direction of rotation and the speed of rotation of the nozzle assembly. This information is transmitted either wirelessly or via wires to a computer or monitor at a central location where a user can easily monitor the operation of a plurality of units.

In one aspect, a first magnet is connected to the nozzle assembly and adapted to produce a first magnetic field, wherein the first magnet rotates in response to the rotation of the nozzle assembly. A sensor unit comprising a Hall-effect sensor is mounted adjacent to the nozzle assembly for detecting the first magnetic field when the nozzle assembly is rotating.

In another aspect, a second magnet is connected to the nozzle assembly and adapted to produce a second magnetic field that rotates in response to the rotation of the nozzle assembly. The sensor unit comprises two Hall-effect sensors, and detects the second magnetic field when the nozzle assembly is rotating. Additionally the sensor unit detects the direction of rotation and the speed of rotation of the nozzle assembly.

There are additional aspects to the present inventions. It should therefore be understood that the preceding is merely a brief summary of several embodiments and aspects, and that additional embodiments and aspects of the present inventions are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

These and/or other aspects and advantages of the present invention will become apparent and more readily appreciated from the following description of the preferred embodiments, taken in conjunction with the accompanying drawings of which:

DETAILED DESCRIPTION

Figure 1:
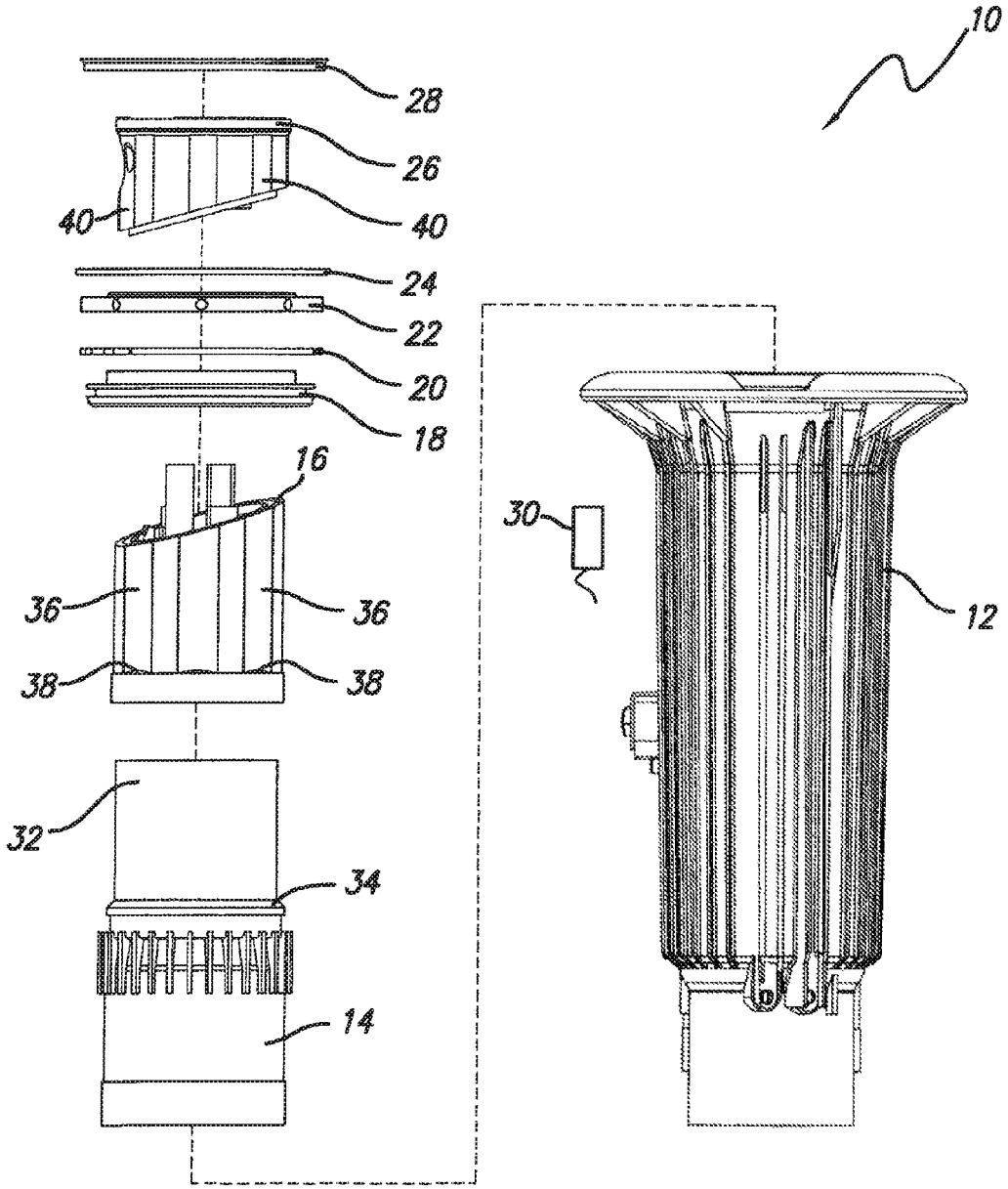
FIG. 1 is an exploded parts diagram of an irrigation sprinkler according to one embodiment of the invention.

Reference will now be made in detail to exemplary embodiments of the present invention, which are illustrated in the accompanying drawings, and wherein like reference numerals refer to like elements throughout. It is understood that other embodiments may be utilized and structural and operational changes may be made without departing from the scope of the present invention.

According to one embodiment of the invention, an irrigation sprinkler is disclosed that includes a rotatable nozzle assembly with a plurality of magnets coupled or connected to the nozzle assembly so that they synchronously rotate with it. A stationary sensor unit is mounted adjacent to the magnets and provides electrical signals in response to the magnetic fields produced by the rotating magnets.

The sensor unit includes two Hall-effect sensors located in one housing. When a magnetic field associated with one magnet sweeps past one of the Hall-effect sensors, and then sweeps past the other Hall-effect sensor, the direction of rotation can be determined. Moreover, when a magnetic field associated with one magnet sweeps past one Hall-effect sensor, and then a second magnetic field associated with a second magnet sweeps past the same Hall-effect sensor, the time that elapses between these events can be measured and a speed of rotation calculated.

Thus by generating electric signals indicative of nozzle assembly direction and speed of rotation, the sensor unit and associated electronics can provide a signal indicative of the direction and speed of rotation for each irrigation sprinkler which signals can then be transmitted, either wirelessly or via wires, to a computer or monitor or other electronic device having a processor located remotely from each irrigation sprinkler. This enables a user who is in a central location to monitor the operation of many, widely-dispersed irrigation sprinklers without having to travel in the field for monitoring purposes.

FIG. 1 is an exploded parts diagram of an irrigation sprinkler 10 in accordance with one embodiment of the invention. Referring to FIG. 1, the irrigation sprinkler 10 comprises a riser 14 having a tubular upper portion 32 and a tapered O-ring seal 34 extending around a lower end of the tubular upper portion 32. The riser 14 is adapted to fit within a case 12 and to move vertically relative to the case from a lower inoperative position to an upper operative position in response to water pressure. A nozzle base 16 is adapted to mate with the tubular upper portion 32 of the riser 14. Thus when the riser 14 moves vertically, it carries the nozzle base 16 along with it. The nozzle base 16 includes a plurality of vertical grooves 36 formed on the exterior surface of the base 16, each of which terminates in a ledge 38 located near the lower end of the nozzle base 16.

A bearing guide 18, a lower snap ring 20, a rotating ring 22, and an upper snap ring 24 are each adapted to surround the nozzle base 16 and fit within the case 12. As will be explained in further detail below, the bearing guide 18, the lower snap ring 20, and the upper snap ring 24 are adapted to rigidly seat within the case 12, whereas the rotating ring 22 is adapted to "float" within the case 12.

A nozzle housing 26 mates with the nozzle base 16 (thereby forming a nozzle assembly), and includes vertical nozzle housing grooves 40 formed on the exterior surface of the nozzle housing 26 that are aligned with the grooves 36 in the nozzle base 16. In response to pressurized water flowing through the irrigation sprinkler 10, the nozzle base 16 and nozzle housing 26 rotate with respect to the riser 14 and the case 12. A rubber collar 28 is seated at the top of the case 12 and surrounds the nozzle housing 26. This serves to prevent debris from entering the case assembly. A sensor unit 30 is attached to the exterior of the case 12, and located near its upper portion.

While the embodiment of FIG. 1 shows the nozzle base 16 and the nozzle housing 26 as separate components that are adapted to mate with one another, an alternative embodiment could include these two components being constructed as a single part, thereby forming a unitary nozzle assembly.

Figure 2:
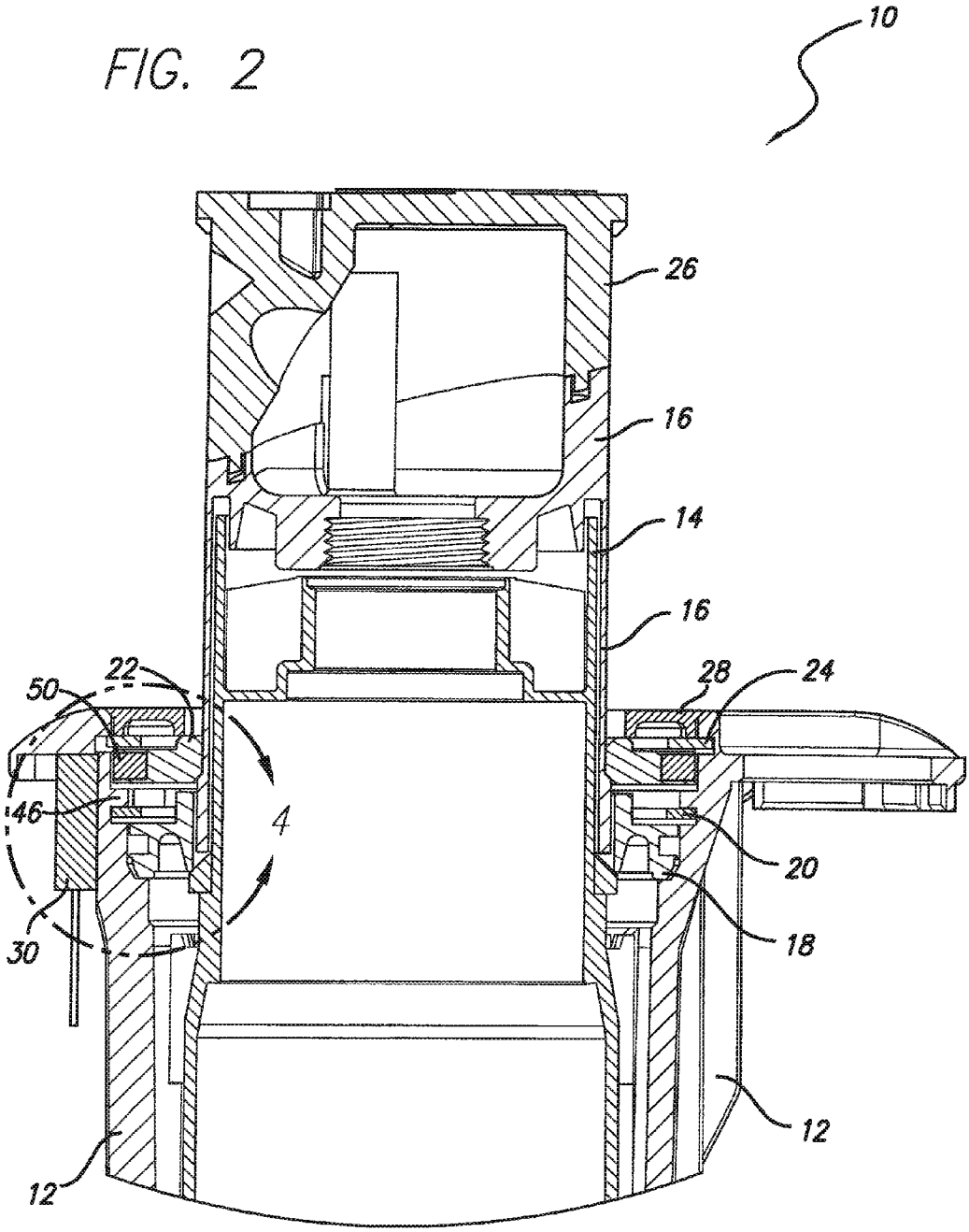
FIG. 2 is a cross-sectional view of the irrigation sprinkler of FIG. 1.
Figure 3:
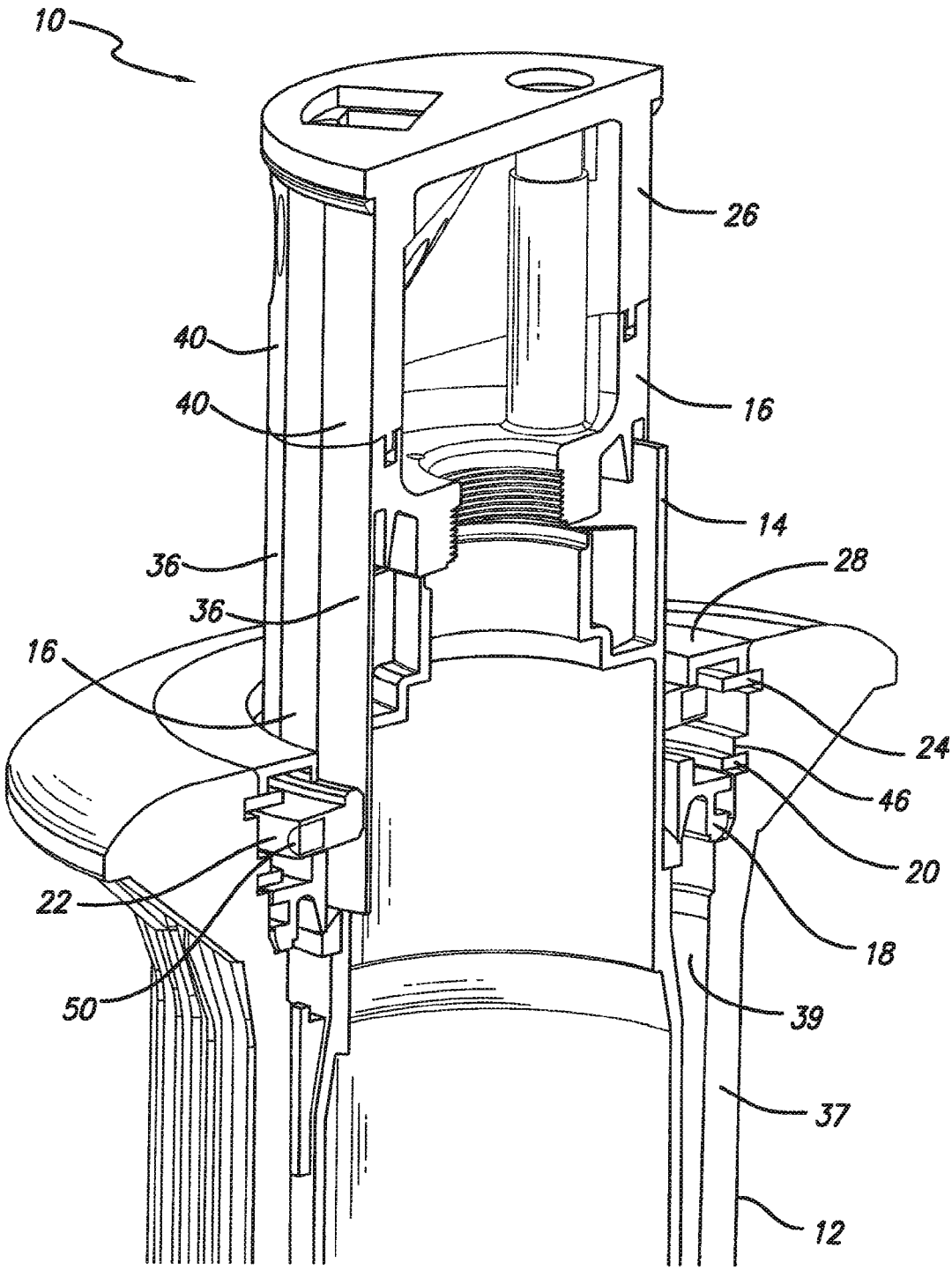
FIG. 3 is a perspective, cut-away view of the irrigation sprinkler of FIG. 1.
Figure 4:
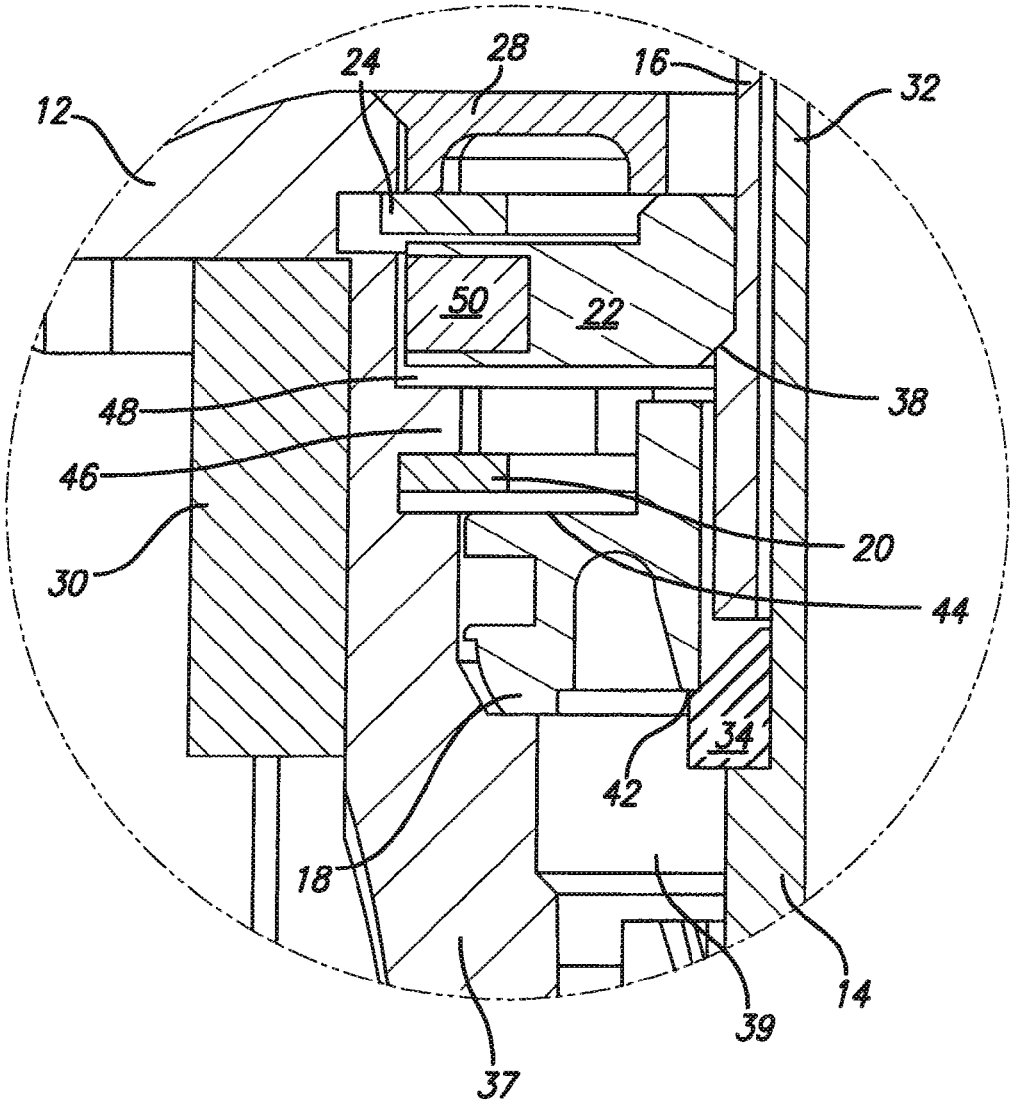
FIG. 4 is an enlarged cross-sectional view of a portion of FIG. 2.

FIGS. 2, 3, and 4 show cross-sectional and cut-away views of the irrigation sprinkler 10 when in the fully extended position. The case 12 has a case wall 37 constructed of plastic and defining a generally hollow case interior 39. The bearing guide 18 is seated within the case interior 39 and has a bottom surface 42 that is positioned to abut the O-ring 34 that is seated on the riser 14 when the riser 14 is in the fully extended position. The bearing guide 18 therefore acts as a "stop" for the riser 14 thereby preventing it from extending upwardly any further. Additionally, the bearing guide 18 serves to seal irrigation water to the areas below the bearing guide 18 and prevent or minimize water from entering the regions of the sprinkler 10 located above the bearing guide 18.

The lower snap ring 20 is rigidly seated in the case interior 39 and is located to contact or abut an upper surface 44 of the bearing guide 18 thereby maintaining the bearing guide 18 in position so that it may seal the compartment below. The rotating ring 22 is adapted to fit within the case 12 and surround the nozzle base 16 and tubular upper portion 32 of the riser 14. The rotating ring 22 is constructed of plastic and sits on a seating surface or flange 46 of the interior of the case 12 when the riser 14 and the nozzle base 38 are in a relatively lower vertical position. However, when the riser 14 and nozzle base 16 move vertically upward, they slide vertically relative to the rotating ring 22 which remains in a relatively stationary, vertical position. As shown in FIGS. 2-4, as the nozzle base 16 reaches the fully extended position, the nozzle base ledge 38 abuts the rotating ring 22 and raises it off of the case flange 46, thereby creating a small gap 48 between the rotating ring 22 and the case flange 46.

The rotating ring 22 is rotatably coupled to the nozzle base 16 so that when the nozzle base 16 rotates, the ring 22 synchronously rotates with it. Because the rotating ring 22 is lifted off of the case flange 46 when the nozzle base 16 is extended, the ring 22 "floats" as it is rotating thereby reducing or eliminating friction and drag between the case 12, the rotating ring 22, and the nozzle base 16 as it rotates.

A plurality of magnets 50 are attached to the rotating ring 22 by embedding them within the ring 22 and are disposed at a radially outward portion of the ring 22. The sensor unit 30 is mounted on the outside of the plastic case 12 at a location adjacent to the rotating ring 22. In the illustrated embodiment, the sensor unit 30 includes two Hall-effect sensors (not shown) enclosed within the sensor unit 30. As previously mentioned, Hall-effect sensors provide an electrical output when placed within a magnetic field.

Therefore, as best seen in FIG. 4, the sensor unit 30 is placed adjacent to the rotating ring 22 and the nozzle base 16 so that magnetic fields associated with the plurality of magnets 50 may be detected by the two Hall-effect sensors located within the sensor unit 30.

The sensor unit 30 employing Hall-effect sensors is advantageous in that the unit 30 is positioned on the outside of the case 12 where it will not come in contact with the water flowing through the irrigation sprinkler 10. Yet once positioned sufficiently close to the magnets 50, the Hall-effect sensors will detect the magnetic fields generated by the magnets 50. Because the case 12, the rotating ring 22 and other nearby components are generally constructed of plastic, interference and distortion of the magnetic fields is minimized.

By employing two Hall-effect sensors within the sensor unit 30, an electrical signal can be generated to provide an indication of the direction of rotation (i.e., counterclockwise or clockwise) of the nozzle assembly. That is, when the magnetic field of one of the magnets 50 passes through one Hall-effect sensor and then passes through the second Hall-effect sensor, the order of receipt by system electronics of the electrical signals generated by each Hall-effect sensor would indicate the direction of rotation.

Additionally, one of the two Hall-effect sensors is used to provide signals from which the speed of rotation can be determined. By employing a plurality of magnets 50 in the rotating ring 22, a separate signal will be generated by the Hall-effect sensor for each magnetic field that passes through it as a result of each magnet. The time differential between each of the passing magnetic fields can be measured by system electronics and thereby, a rotational speed can be calculated.

Although the illustrated embodiment uses Hall-effect sensors, it will be appreciated by those skilled in the art that other types of sensors capable of detecting one or more magnetic fields may be substituted for the Hall-effect sensors illustrated herein. Such magnetic field detection includes not only the detection of the presence of magnetic fields, but also the variations within one or more fields so that changes over time in field strength or direction are detected. Examples of other types of sensors include proximity sensors, reed switch sensors, inductive sensors, magnetoresistive sensors, fiber-optic sensors, flux-gate magnetometers, magnetoinductive magnetometers, anisotropic magnetoresistive sensors, giant magnetoresistive sensors, and bias magnet field sensors.

Still referring to FIGS. 2-4, the upper snap ring 24 is seated on the interior of the case wall 37 and is positioned so that an upper surface of the rotating ring 22 can abut the upper snap ring 24. Thus the upper snap ring 24 engages with the case 12 and prevents the rotating ring 22 from being thrown out of the case 12. As previously mentioned, the rubber collar 28 is seated in the case 12 and above the upper snap ring 24. As best seen in FIG. 4, the rubber collar 28 lies flush against an upper portion of the case 12 and helps to prevent debris from entering it.

Figure 5A:
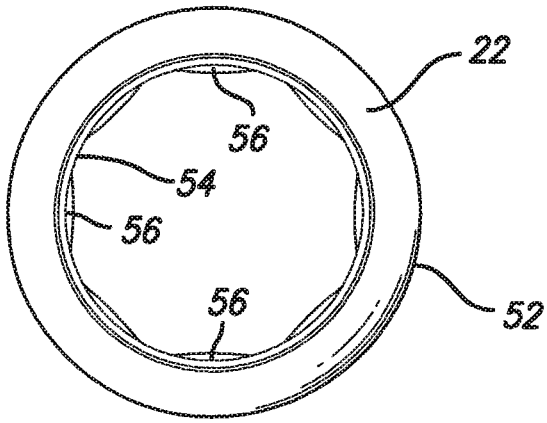
FIG. 5*a* is a top plan view of a rotating ring of the irrigation sprinkler of FIG. 1.
Figure 5B:
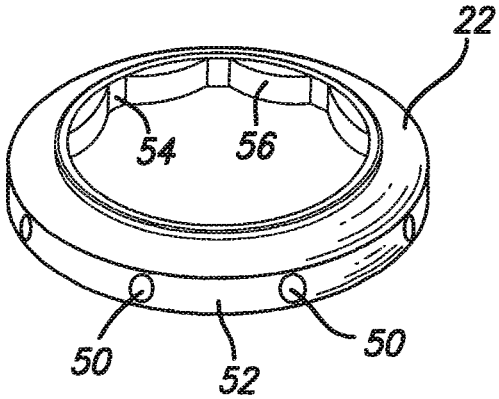
FIG. 5*b* is a perspective view of the rotating ring of FIG. 5*a*.

FIGS. 5*a* and 5*b* illustrate the rotating ring 22 of FIGS. 1-4. The rotating ring 22 has an outer radial surface 52, an inner radial surface 54 and a plurality of projections 56 extending radially inward from the inner radial surface 54. The projections 56 are adapted to mate with the nozzle base grooves 36 and the nozzle housing grooves 40 thereby slidably mating the rotating ring 22 with the nozzle base 16 and housing 26. Thus when the nozzle base 16 rotates in response to the water pressure, the rotating ring 22 and the plurality of magnets 50 will be synchronously rotated with the nozzle base 16. However, when the nozzle base 16 moves vertically between a lower position and an upper or extended position, the base 16 will slide through the surrounding rotating ring 22 which will remain in a relatively stationary vertical position.

FIGS. 5*a* and 5*b* show the plurality of projections 56 (or flats or ledges) arranged in an octagonal pattern adapted to mate with the nozzle base and housing grooves 36, 40. However, alternative embodiments may include any coupler arrangement or geometry, including one or more single tabs or other types of projections extending from the rotating ring 22 and mating with the nozzle base 16, one or more tabs or other types of projections extending from the nozzle base 16 and mating with the rotating ring 22, etc.

In the illustrated embodiment, the magnets are connected to the nozzle assembly via the rotating ring 22 which is rotatably and slidably coupled to the nozzle assembly. In alternative embodiments, however, a rotating ring need not be used. Rather, one or more magnets may be connected to a nozzle assembly by directly attaching them to the nozzle assembly or integrally incorporating them with the nozzle assembly so that the magnets are directly carried with and moved by the nozzle assembly.

In the illustrated embodiment, eight magnets 50 are equally spaced about the periphery of the rotating ring 22 so that an arc of about 45° would likely encompass any two adjacent magnets 50. With this resolution, an irrigation rotor that is set for a spray pattern arc as small as 45° should nevertheless provide automatic rotor speed and direction detection capabilities. Alternative embodiments of the invention, however, may use a greater or fewer number of magnets, although such variations may affect speed and direction detection capabilities.

In the illustrated embodiment, the magnets are connected to the nozzle assembly in such a way that they rotate in response to the rotation of the nozzle assembly. In alternative embodiments, one or more magnets are attached to the nozzle assembly so that the magnets move vertically when the nozzle assembly moves from a lower inoperative position to an upper operative position. A sensor unit is disposed adjacent to the nozzle assembly in such a manner that it detects one or more magnetic fields as their associated magnets move vertically. Thus the sensor unit provides a signal that is indicative of the vertical position of the nozzle assembly.

As previously mentioned, alternative embodiments of the invention include the use of various types of sensors that detect magnetic fields (including in some instances the detection of variations over time within one or more magnetic fields). Some of these sensors can detect the presence of a ferrous material that is not permanently magnetized by detecting a variation over time in one or more magnetic fields that have been influenced by the presence of the ferrous material as it passes through the magnetic fields.

Therefore, alternative embodiments of the invention include a movable nozzle assembly having one or more pieces of ferrous material that are not permanently magnetized and that are connected to the nozzle assembly (i.e., integral with the assembly or coupled or attached to the assembly). For example, these pieces of ferrous material could be non-magnetized metal that replaces the magnets 50 that are attached to the rotating ring 22 as shown in FIG. 5*b*. Alternatively, one or more pieces of ferrous material may be connected to the nozzle assembly by directly attaching them to the nozzle assembly (including making the pieces an integral portion or component of the nozzle assembly) so that the pieces are directly carried with and moved in any direction (e.g., vertically or rotationally) along with the nozzle assembly.

One or more magnetic fields are generated by one or more magnetic field sources located in or near one or more sensors, but not necessarily connected to the nozzle assembly. The magnetic sources can include permanent magnets, electromagnets or an electrical current. Thus as the one or more pieces of ferrous material that are connected to the moving nozzle assembly pass through the one or more magnetic fields, the sensors detect variations over time in these magnetic fields that are caused by the presence of the ferrous material. Accordingly nozzle assembly position, speed of rotation or direction of rotation (or any combination thereof) can be detected.

Thus disclosed is an irrigation sprinkler comprising a nozzle assembly for dispersing water to an area of vegetation by movement of at least a portion of the nozzle assembly. According to one embodiment, the nozzle assembly is rotatable and has a plurality of magnets connected to the nozzle assembly so that they synchronously rotate with it. A sensor unit is mounted adjacent to the magnets and provides electrical signals in response to the magnetic fields produced by the rotating magnets. These electrical signals are used to provide information as to both the direction of rotation and the speed of rotation of the nozzle assembly. This information is transmitted either wirelessly or via wires to a computer or monitor or other device at a central location where a user can easily monitor the operation of a plurality of units.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. An irrigation sprinkler comprising:

a nozzle assembly for dispersing water to an area of vegetation, at least a portion of the nozzle assembly being rotatable about an axis due to water pressure;

a first magnet rotationally connected to the at least a portion of the nozzle assembly, the first magnet producing a magnetic field, the nozzle assembly being movable relative to the first magnet along the axis; and a sensor unit isolated from any water received by the sprinkler and disposed for detecting the first magnetic field when the at least a portion of the nozzle assembly is rotating.

2. The sprinkler of claim 1, wherein the sensor unit comprises at least one of a Hall-effect sensor, a proximity sensor, a reed switch sensor, an inductive sensor, a magnetoresistive sensor, a fiber-optic sensor, a flux-gate magnetometer, a magnetoinductive magnetometer, an anisotropic magnetoresistive sensor, a giant magnetoresistive sensor, and a bias magnet field sensor.

3. The sprinkler of claim 1 further comprising a case containing the nozzle assembly wherein the sensor unit is disposed outside of the case.

4. An irrigation sprinkler comprising:

a nozzle assembly for dispersing water to an area of vegetation, at least a portion of the nozzle assembly being rotatable about an axis due to water pressure;

a first magnet rotationally connected to the at least a portion of the nozzle assembly, the first magnet producing a magnetic field, the nozzle assembly being axially movable along the axis relative to the first magnet;

a sensor unit isolated from any water received by the sprinkler and disposed for detecting the first magnetic field when the at least a portion of the nozzle assembly is rotating; and a second magnet rotationally connected to the at least a portion of the nozzle assembly, the second magnet producing a second magnetic field; and wherein the sensor unit is further disposed for detecting the second magnetic field when the at least a portion of the nozzle assembly is rotating.

5. The sprinkler of claim 4 wherein the sensor unit produces signals from which a speed of rotation of the at least a portion of the nozzle assembly can be determined.

6. An irrigation sprinkler comprising:

a nozzle assembly for dispersing water to an area of vegetation, at least a portion of the nozzle assembly being rotatable about an axis due to water pressure;

a first magnet rotationally connected to the at least a portion of the nozzle assembly, the first magnet producing a magnetic field, the nozzle assembly being axially movable along the axis relative to the first magnet; and a sensor unit isolated from any water received by the sprinkler and disposed for detecting the first magnetic field when the at least a portion of the nozzle assembly is rotating, wherein the sensor unit comprises two Hall-effect sensors, and wherein the sensor unit produces signals from which a direction of rotation of the at least a portion of the nozzle assembly can be determined.

7. An irrigation sprinkler comprising:

a nozzle assembly for dispersing water to an area of vegetation, at least a portion of the nozzle assembly being rotatable about an axis due to water pressure;

a first magnet rotationally connected to the at least a portion of the nozzle assembly, the first magnet producing a magnetic field, the nozzle assembly being axially movable along the axis relative to the first magnet;

a sensor unit isolated from any water received by the sprinkler and disposed for detecting the first magnetic field when the at least a portion of the nozzle assembly is rotating; and a generally ring-shaped member surrounding the at least a portion of the nozzle assembly and cooperatively engaging the at least a portion of the nozzle assembly, wherein the first magnet is attached to the generally ring-shaped member.

8. The sprinkler of claim 7 wherein the generally ring-shaped member has an outer radial surface, an inner radial surface, and at least one projection extending radially inward from the inner radial surface, and wherein the nozzle assembly defines at least one groove slidably mating with the at least one projection.

9. The sprinkler of claim 1, further comprising:

a lower inoperative position of the nozzle assembly, an upper operative position of the nozzle assembly wherein the first magnet is axially supported by the nozzle assembly, and wherein the nozzle assembly is free to move axially relative to the first magnet during movement between the lower inoperative position and the upper operative position.

10. The sprinkler of claim 1, further comprising a case surrounding the at least a portion of the nozzle assembly, wherein the first magnet is disposed on a member connecting the first magnet to the at least a portion of the nozzle assembly, and wherein the nozzle assembly shifts vertically to move the member and the first magnet to an operative position forming minimal friction between the member and the case.

11. The sprinkler of claim 10 wherein the case has a case seating surface and the nozzle assembly has a ledge for abutting the member and lifting the member off of the case seating surface to place the first magnet in the operative position.

12. An irrigation sprinkler comprising:

a nozzle assembly vertically movable between a lower inoperative position and an upper operative position in response to water pressure, and being rotatable in response to the water pressure;

a generally ring-shaped member coupled to the nozzle assembly for rotation therewith and uncoupled from the nozzle assembly so that the nozzle assembly moves axially relative thereto;

a magnet attached to the generally ring-shaped member and producing a first magnetic field; and a sensor unit disposed adjacent to the nozzle assembly and isolated from any water for detecting the first magnetic field when the nozzle assembly is rotating.

13. The sprinkler of claim 12 wherein the sensor unit comprises at least one of a Hall-effect sensor, a proximity sensor, a reed switch sensor, an inductive sensor, a magnetoresistive sensor, a fiber-optic sensor, a flux-gate magnetometer, a magnetoinductive magnetometer, an anisotropic magnetoresistive sensor, a giant magnetoresistive sensor, and a bias magnet field sensor.

14. The sprinkler of claim 12 further comprising a case containing the nozzle assembly wherein the sensor unit is disposed outside of the case.

15. An irrigation sprinkler comprising:

a nozzle assembly vertically movable between a lower inoperative position and an upper operative position in response to water pressure, and being rotatable in response to the water pressure;

a generally ring-shaped member coupled to the nozzle assembly when the nozzle assembly is rotating;

a magnet attached to the generally ring-shaped member and producing a first magnetic field;

a sensor unit disposed adjacent to the nozzle assembly and isolated from any water for detecting the first magnetic field when the nozzle assembly is rotating;

a second magnet attached to the generally ring-shaped member and producing a second magnetic field; and wherein the sensor unit is further disposed for detecting the second magnetic field when the nozzle assembly is rotating.

16. The sprinkler of claim 15 wherein the sensor unit comprises two Hall-effect sensors, and the sensor unit providing signals from which a direction of rotation and a speed of rotation of the nozzle assembly can be determined.

17. An irrigation sprinkler comprising:

a nozzle assembly vertically movable between a lower inoperative position and an upper operative position in response to water pressure, and being rotatable in response to the water pressure;

a generally ring-shaped member coupled to the nozzle assembly when the nozzle assembly is rotating;

a magnet attached to the generally ring-shaped member and producing a first magnetic field;

a sensor unit disposed adjacent to the nozzle assembly and isolated from any water for detecting the first magnetic field when the nozzle assembly is rotating; and a plurality of additional magnets attached to the generally ring-shaped member producing a plurality of additional magnetic fields; and wherein the sensor unit is further disposed for detecting the plurality of additional magnetic fields when the nozzle assembly is rotating and for providing signals from which a speed of rotation of the nozzle assembly can be determined.

18. An irrigation sprinkler comprising:

a nozzle assembly vertically movable between a lower inoperative position and an upper operative position in response to water pressure, and being rotatable in response to the water pressure;

a generally ring-shaped member coupled to the nozzle assembly when the nozzle assembly is rotating;

a magnet attached to the generally ring-shaped member and producing a first magnetic field;

a sensor unit disposed adjacent to the nozzle assembly and isolated from any water for detecting the first magnetic field when the nozzle assembly is rotating; and wherein the generally ring-shaped member has an outer radial surface, an inner radial surface, and at least one projection extending radially inward from the inner radial surface, and wherein the nozzle assembly defines at least one groove slidably mating with the at least one projection.

19. An irrigation sprinkler comprising:

a nozzle assembly vertically movable between a lower inoperative position and an upper operative position in response to water pressure, and being rotatable in response to the water pressure;

a generally ring-shaped member coupled to the nozzle assembly when the nozzle assembly is rotating;

a magnet attached to the generally ring-shaped member and producing a first magnetic field;

a sensor unit disposed adjacent to the nozzle assembly and isolated from any water for detecting the first magnetic field when the nozzle assembly is rotating;

a case surrounding at least a portion of the nozzle assembly, said case having a case seating surface, wherein the generally ring-shaped member abuts the case seating surface when the nozzle assembly is in the lower inoperative position; and wherein the nozzle assembly has a ledge abutting the generally ring-shaped member and lifting the generally ring-shaped member off of the case seating surface when the nozzle assembly is in the upper operative position.

20. An irrigation sprinkler comprising:

a nozzle assembly for dispersing water to an area of vegetation;

a first piece of non-magnetized metal connected to the nozzle assembly and configured to move in response to at least rotational movement of the nozzle assembly about an axis;

a first magnetic field source for producing a first magnetic field, wherein the first magnetic field changes in response to the presence in the first magnetic field of at least a portion of the first piece of non-magnetized metal;

the nozzle assembly being movable relative to the first magnetic field source along the axis; and a first sensor isolated from any water for detecting the change in the first magnetic field.

21. The sprinkler of claim 20 further comprising a case containing the nozzle assembly wherein the first sensor is disposed outside of the case.

22. An irrigation sprinkler comprising:

a nozzle assembly for dispersing water to an area of vegetation;

a first piece of non-permanently magnetized ferrous material connected to the nozzle assembly and moving in response to a movement of at least a portion of the nozzle assembly;

a first magnetic field source for producing a first magnetic field, wherein the first magnetic field changes in response to the presence in the first magnetic field of at least a portion of the first piece of non-permanently magnetized ferrous material; and a first sensor isolated from any water for detecting the change in the first magnetic field;

a second piece of non-permanently magnetized ferrous material connected to the nozzle assembly and moving in response to the movement of the at least a portion of the nozzle assembly;

a second magnetic field source for producing a second magnetic field, wherein the second magnetic field changes in response to the presence in the second magnetic field of at least a portion of the second piece of non-permanently magnetized ferrous material; and a second sensor isolated from any water for detecting the change in the second magnetic field.

23. The sprinkler of claim 22 wherein the movement of the first and second pieces of non-permanently magnetized ferrous material is a rotation and the movement of the at least a portion of the nozzle assembly is a rotation, and wherein the first and second sensors produce signals from which a direction of rotation and a speed of rotation of the at least a portion of the nozzle assembly can be determined.

24. An irrigation sprinkler comprising:

a nozzle assembly for dispersing water to an area of vegetation;

a first piece of non-permanently magnetized ferrous material connected to the nozzle assembly and moving in response to a movement of at least a portion of the nozzle assembly;

a first magnetic field source for producing a first magnetic field, wherein the first magnetic field changes in response to the presence in the first magnetic field of at least a portion of the first piece of non-permanently magnetized ferrous material;

a first sensor isolated from any water for detecting the change in the first magnetic field; and a generally ring-shaped member surrounding the at least a portion of the nozzle assembly and cooperatively engaging with the at least a portion of the nozzle assembly, wherein the generally ring-shaped member comprises the first piece of non-permanently magnetized ferrous material.

25. An irrigation sprinkler comprising:

a nozzle assembly for dispersing water to an area of vegetation;

a first piece of non-permanently magnetized ferrous material connected to the nozzle assembly and moving in response to a movement of at least a portion of the nozzle assembly;

a first magnetic field source for producing a first magnetic field, wherein the first magnetic field changes in response to the presence in the first magnetic field of at least a portion of the first piece of non-permanently magnetized ferrous material;

a first sensor isolated from any water for detecting the change in the first magnetic field;

a generally ring-shaped member surrounding the at least a portion of the nozzle assembly and cooperatively engaging with the at least a portion of the nozzle assembly, wherein the generally ring-shaped member comprises the first piece of non-permanently magnetized ferrous material; and the generally ring-shaped member has an outer radial surface, an inner radial surface, and a projection extending radially inward from the inner radial surface, and wherein the nozzle assembly defines a groove adapted to slidably mate with the projection.

26. An irrigation sprinkler comprising:

a nozzle assembly for dispersing water to an area of vegetation;

a first piece of non-permanently magnetized ferrous material connected to the nozzle assembly and moving in response to a movement of at least a portion of the nozzle assembly;

a first magnetic field source for producing a first magnetic field, wherein the first magnetic field changes in response to the presence in the first magnetic field of at least a portion of the first piece of non-permanently magnetized ferrous material;

a first sensor isolated from any water for detecting the change in the first magnetic field;

a generally ring-shaped member surrounding the at least a portion of the nozzle assembly and cooperatively engaging with the at least a portion of the nozzle assembly, wherein the generally ring-shaped member comprises the first piece of non-permanently magnetized ferrous material;

a case surrounding the at least a portion of the nozzle assembly, said case having a case seating surface, wherein the nozzle assembly moves vertically relative to the case from a lower position to an upper position, wherein the generally ring-shaped member abuts the case seating surface when the nozzle assembly is in the lower position, and wherein the nozzle assembly has a ledge abutting the generally ring-shaped member and lifting the generally ring-shaped member off of the case seating surface when the nozzle assembly is in the upper position.

27. An irrigation sprinkler for use with water provided at a water pressure, the irrigation sprinkler comprising:

a nozzle assembly vertically movable between a lower assembly position and an upper assembly position in response to the water pressure, the nozzle assembly further being rotatable in response to the water pressure;

a first magnetic field source adapted to produce a first magnetic field;

means for detecting the first magnetic field thereby providing an indication of at least one of a nozzle assembly position, a speed of nozzle assembly rotation, and a direction of nozzle assembly rotation;

means for rotating the first magnetic field source synchronously with the rotation of the nozzle assembly; and a second magnetic field source for producing a second magnetic field, wherein the means for rotating the first magnetic field source includes means for rotating the second magnetic field source synchronously with the rotation of the nozzle assembly.

28. The sprinkler of claim 27 wherein the means for detecting the first magnetic field includes means for detecting the second magnetic field thereby providing an indication of both the direction of nozzle assembly rotation and the speed of nozzle assembly rotation.

29. The sprinkler of claim 27 further comprising:

a case surrounding at least a portion of the nozzle assembly, said case having a case seating surface;

wherein the nozzle assembly moves vertically relative to the case between the lower assembly position and the upper assembly position, wherein the means for rotating the magnetic field source abuts the case seating surface when the nozzle assembly is in the lower assembly position, and wherein the nozzle assembly has a ledge abutting the means for rotating the magnetic field source and lifting the means for rotating the magnetic field source off of the case seating surface when the nozzle assembly is in the upper assembly position.

30. The sprinkler of claim 27 wherein the means for detecting the first magnetic field is isolated from any water.

31. An irrigation sprinkler comprising:

a nozzle assembly for dispersing water to an area of vegetation;

a first piece of non-permanently magnetized ferrous material connected to the nozzle assembly and configured to move in response to at least rotational movement of the nozzle assembly about an axis;

a first magnetic field source for producing a first magnetic field, wherein the first magnetic field changes in response to the presence in the first magnetic field of at least a portion of the first piece of non-permanently magnetized ferrous material;

the nozzle assembly being movable relative to the first magnetic field source along the axis;

a first sensor isolated from any water for detecting the change in the first magnetic field;

a second magnetic field source for producing a second magnetic field, wherein the second magnetic field changes in response to the presence in the second magnetic field of at least a portion of the first piece of non-permanently magnetized ferrous material; and a second sensor isolated from any water for detecting the change in the second magnetic field.

32. The irrigation sprinkler of claim 20 wherein the first magnetic field source is located in the first sensor.

33. The irrigation sprinkler of claim 20 further comprising:

a second magnetic field source for producing a second magnetic field, wherein the second magnetic field changes in response to the presence in the second magnetic field of at least a portion of the first piece of the non-magnetized metal; and a second sensor isolated from any water for detecting the change in the second magnetic field.

* * * * *